US006136435A

United States Patent [19]

Yoshimura et al.

[11] Patent Number: 6,136,435

[45] Date of Patent: Oct. 24, 2000

[54] POLYESTER FILAMENT YARN

[75] Inventors: Mie Yoshimura, Ibaraki; Toshimasa Kuroda, Takatsuki, both of Japan

[73] Assignee: Teijin Limited, Osaka, Japan

[21] Appl. No.: 09/424,015

[22] PCT Filed: Mar. 19, 1999

[86] PCT No.: PCT/JP99/01420

§ 371 Date: Dec. 27, 1999

§ 102(e) Date: Dec. 27, 1999

[87] PCT Pub. No.: WO99/47735

PCT Pub. Date: Sep. 23, 1999

[30] Foreign Application Priority Data

Mar. 19, 1998 [JP] Japan ..... 10-70136

[51] Int. Cl.[7] ..... D01F 5/00

[52] U.S. Cl. ..... 428/372; 428/395; 264/172.17

[58] Field of Search ..... 428/364, 372, 428/395; 525/176; 264/172.17

[56] References Cited

U.S. PATENT DOCUMENTS 5,565,522 10/1996 Bohringer et al. ..... 525/176

FOREIGN PATENT DOCUMENTS 0 047 464 3/1982 European Pat. Off. .

0 860 524 8/1998 European Pat. Off. .

WO 93/19231 9/1993 WIPO .

WO 99 07927 2/1999 WIPO .

*Primary Examiner*—N. Edwards

*Attorney, Agent, or Firm*—Foley & Lardner

[57] ABSTRACT

A polyester filament yarn produced by a melt-spinning a mixture of a polyester resin with 0.4 to 4.0 weight % of filament elongation-enhancing agent particles and taking up the filament yarn at a speed of 2500 to 8000 m/minutes, having an increase in residual elongation of 50% or more and exhibiting an improved winding performance, wherein the filament elongation-enhancing agent particles satisfies the requirements (a), (b) and (c):

(a) the particles have a thermal deformation temperature of 105 to 130° C., (b) provided that the polyester filaments have a non-hollow circular cross-section, the distribution density of the particles is maximized in an annular area between two concentric circles around the center of the cross-section, of which the two concentric circles have radiuses corresponding to ⅓ and ⅔ of the radius of the cross section, respectively; and (c) the number of the particles appearing on the filament surfaces is 15 particles/100 $\mu m^2$ or less.

15 Claims, 3 Drawing Sheets

POLYESTER FILAMENT YARN

TECHNICAL FIELD

The present invention relates to a polyester filament yarn having an improved winding performance and a large increase in residual elongation, and a process for producing the same.

More particularly, the present invention relates to a polyester filament yarn having an improved winding performance and a large increase in residual elongation, obtained by preparing a melt of a mixture of a polyester resin and particles of an addition-polymerization product of a unsaturated monomer, which particles have a specific thermal deformation temperature (T), and are dispersed in a melt of a polyester resin, by melt-extruding the melt mixture and by taking up the resultant polyester filament yarn at a high speed to cause the addition polymerization product particles dispersed in each filament to be elongated along the longitudinal axis of the filament, and provided that the filament has a non-hollow circular cross-section, the distribution density of the particles to be maximized in an annular area between two concentric circles having radiuses corresponding to ⅓ and ⅔ of the radius of the circular cross-section of the filament, and to a process for producing the same.

BACKGROUND ART

In a melt-spinning for a polyester filament yarn, an increase as large as possible in the extruding rate of the polymer through a spinneret significantly contributes to enhancing the productivity of the polyester filament yarn. In the current fiber industry, the above-mentioned increase in the extruding rate is considered to be preferable from a point of view of a cost reduction in the production of the polyester filament yarn.

As a typical means for enhancing the productivity of the polyester filament yarn, a method in which the extruded polyester filament yarn is taken up at an increased speed to increase the extruding rate of the polyester filament yarn through the spinneret is known. In this conventional method, however, since the taking-up speed of the extruded polyester filament yarn is high, and thus the degree of orientation of the polyester molecules in each polyester filament increases, the resultant filament yarn disadvantageously exhibits a decreased residual elongation. Therefore, naturally, the maximum draw ratio of the polyester filament yarn in the subsequent drawing step or draw-false twisting step decreases. Thus, the disadvantageous decrease in the drawing property of the polyester filament yarn in the drawing or draw-false twisting step offsets the extruding rate-increasing effect due to the increase in the taking-up speed.

As one means for solving the above-mentioned problem, European Patent Publication No. 47464-A1 discloses a polyester filament yarn-producing method in which an addition-polymerization product of an unsaturated organic monomer is added as a filament elongation-enhancing agent to a polyester resin, to increase the residual elongation of the resultant melt-spun polyester filament yarn. In this method of the European patent publication at, for example, page 9, line 3, the addition polymerization product finely dispersed in the particle form molecular size in the polyester resin, and the resultant fine particles of the polymer are considered to serve as rollers or runners for the polyester resin. The European patent publication discloses, as a practical example of the addition-polymerization product, "DELPET 80N". In an actual measurement result, the polymer exhibited a thermal deformation temperature of 98° C.

The above-mentioned method of the European patent publication is useful for producing a partially (or pre-) oriented polyester filament yarn (POY) and a melt-spun polyester filament yarn having a high residual elongation, namely an as-spun filament yarn, and a polyester filament yarn (FOY) produced, under a super high speed, by a coupled spinning and drawing process. However, when the inventors of the present invention have an attempt to wind up the as-spun polyester filament yarn as disclosed in the European patent publication and having a high residual elongation by using a commercially-available winder, they were confronted with new problems.

Namely, the inventors of the present invention have found that in practice, the as-spun polyester filament yarn could not be wound up by the conventional winder, and a wound package of the yarn could not be formed. As phenomena relating to this problem, it has been found that since one or more filaments in the yarn exhibited a poor traverse printing property, in the resultant wound package, a cob-webbing phenomenon in which the yarn fell outside of the edges portion, in the form of a normal circumferential winding state of the wound package, and an irregular winding in the edge portion thereof, by which the surface of the edge portion was disberted to result in destruction of the wound package, occurred. Further, a yarn-float on the yarn package during the yarn was being wound, occurred, and this phenomenon caused bursting of the package. Thus these phenomena may cause a fatal blow against the polyester filament yarn.

The causes of the above-mentioned problems are considered to be that, since the addition polymerization product particles are not compatible with the polyester resin and serve as rollers or runners for the polyester resin, these particles superiorly bleed out on the peripheral surface of the polyester filament to cause the peripheral surface to be too rough, and thus a friction of the filaments with each other (F/F friction), and a friction of the filaments with a metal (F/M friction) to decrease. Therefore, the winding performance of the resultant polyester filament yarn decreases or becomes uneven.

To prevent the decrease in the F/F friction and the F/M friction, a person with ordinary skill in the art will expect to provide a means in which an oiling agent for increasing the F/F friction and the F/M friction is applied to the extruded polyester filament yarn and then the oiled yarn is taken-up and wound. Friction-increasing agents include alkyleneoxide-addition product modified with an aromatic ring or a polyhydric alcohol, for example, polyoxyethylene-octylphenyl ether, polyoxyethylene-nonylphenyl ether, polyoxyethylene-noxylphenyl stearate, polyoxyethylene-p-phenyl ether, and polyoxyethylene-benzylphenyl-phenol ether; and glycerolpropyleneoxide (PO)/ethylene oxide (EO) addition products, sorbitol PO/EO addition product and sorbitan PO/EO addition products. Also, friction-increasing agents include low viscosity compounds having a low lubricating property, for example, polypropyleneglycol with a low molecular weight of 500 to 700; rosin esters and silica.

In fact, when the fiction-increasing agent was applied to the extruded polyester filament yarn before winding, a yarn package could be prepared in a good form. However, when the wound polyester filament yarn was withdrawn from the package and subjected to a subsequent processing, for example, drawing or a false-twisting, formation of fluffs and breakage of the yarn frequently occurred, and thus the processing could not continue and a poor yarn was produced. Therefore, the employment of the friction-increasing agent was unsuccessful in essentially solving the above-mentioned problems.

The term "an improved winding performance", used in the present invention refers to a performance of the polyester filament yarn in that the polyester filament yarn can be stably and smoothly wound in a drawing or draw-texturing processing step without using an oiling agent as described above, which causes formation of fluffs or breakage of the yarn.

DISCLOSURE OF THE INVENTION

An object of the present invention is to provide a polyester filament yarn being free from a fatal defect that a conventional polyester filament yarn produced under a high speed melt-spinning method in conjunction with the use of a filament elongation-enhancing agent can not be wound, while securing the level of the residual elongation of a resultant yarn at least to the same level of said conventional yarn, and a process for producing the same.

Another object of the present invention is to provide a polyester filament yarn being free from a further defect that the conventional yarn can not be smoothly processed in subsequent processings due to the occurrence of fluffs and yarn breakage, and a process for producing the same.

The above-mentioned objects can be attained by the polyester filament yarn, and the process for producing the same, of the present invention.

The polyester filament yarn of the present invention having an improved winding performance, is one produced by melt-spinning a mixture of a polyester resin with particles of a filament elongation-enhancing agent in an amount of 0.5 to 4.0% based on the weight of the polyester resin, and by taking up the melt-spun polyester filament yarn at a speed of 2500 to 8000 m/minute, to form a polyester filament yarn comprising a plurality of filaments each comprising a matrix consisting of the polyester resin and the filament elongation-enhancing agent particles dispersed in the polyester resin matrix, said polyester filament yarn exhibiting an increase (I) in residual elongation of 50% or more, determined in accordance with the equation:

$$I(\%)=(EI_b/EL_o-1)\times 100$$

wherein I represents the increase in residual elongation in % of the polyester filament yarn, $EI_b$ represents a residual elongation in % of the polyester filament yarn, and $EL_o$ represents a residual elongation in % of a comparative polyester filament yarn produced by the same procedures as those for the polyester filament yarn except that no filament elongation-enhancing agent was contained in the comparative polyester filaments, characterized in that said filament elongation-enhancing agent particles contained in the polyester filament satisfies the requirements (a), (b) and (c):

(a) the filament elongation-enhancing agent particles have a thermal deformation temperature (T) in the range of from 105 to 130° C, (b) provided that the polyester filaments have a non-hollow circular cross-section, the distribution density of the filament elongation-enhancing agent particles in the circular cross-section of the polyester filaments is maximized in an annular area between two concentric circles around the center of the circular cross-section, of which the two concentric circles have the radiuses corresponding to ⅓ and ⅔ of the radius of the circular cross-section of the polyester filaments, respectively; and (c) the number (N) of the filament elongation-enhancing agent particles appearing on the peripheral surface of the polyester filaments is 15 particles/100 $\mu m^2$ or less.

Further, the process for producing the polyester filament yarn is as follows.

In a process for producing a polyester filament yarn comprising:

extruding a melt of a mixture of a polyester resin with particles of a filament elongation-enhancing agent in an amount of 0.5 to 4.0% by weight based on the weight of the polyester resin through a spinneret, and taking up the melt-extruded polyester filament yarn at a speed of 2500 to 8000 m/minute, along a spinning line, said process being characterized in that, in the melt-extruding step, the melt passes through a filter having a pore size of 40 $\mu m$ arranged immediate upstream to the spinneret, and in the spinning line, a draft of the melt-extruded polyester filament yarn is controlled to a range of from 150 to 1,500, thus imparting an improved winding performance to said yarn.

BEST MODE OF CARRYING OUT THE INVENTION

Figure 1:
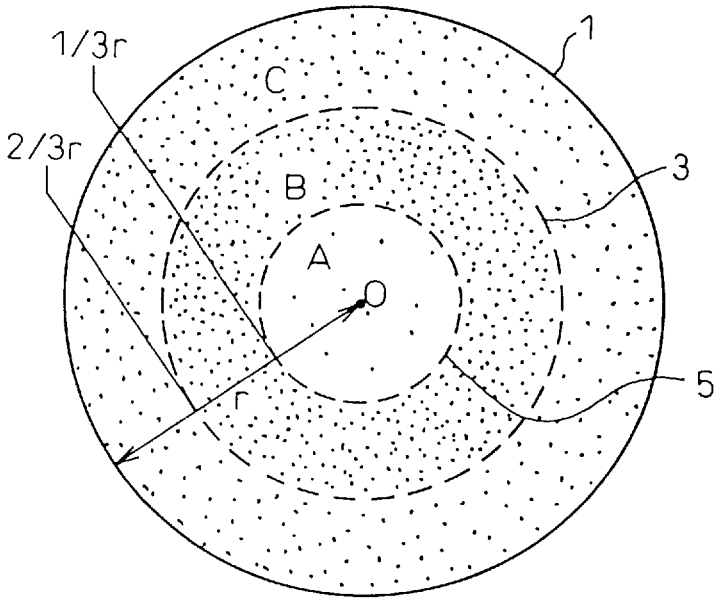
FIG. 1 shows a circular cross-section of a filament for the polyester filament yarn of the present invention, in which cross-section, the distribution state of particles of a filament elongation-enhancing agent in areas A, B and C of the filament are schematically shown.

In the study of the inventors of the present invention, it has been found that when fine particles of a polymer produced by an addition polymerization of an organic unsaturated monomer, incompatible with the polyester resin and having a thermal deformation temperature (T) higher than that of the polyester resin, are mixed, as a filament elongation-enhancing agent, into the polyester resin, and the resultant resin mixture is subjected to a melt-spinning procedure, the particles of the filament elongation-enhancing agent distributed in each polyester filament of the resultant polyester filament yarn serve as resisting materials against elongate-deformation of each filament, rather than as rollers or runner for the polyester molecules, during the thinning process of a melt-extruded filamentary stream, and the filament elongation-enhancing agent particles are oriented and elongated in the longitudinal direction of each polyester filament. Also, it has been found that, provided that the polyester filament has a non-hollow circular cross-section, the distribution density of the above-mentioned filament elongation-enhancing agent particles in the cross-sectional profile of the polyester filament can be maximized in an annular area between two concentric circles around the center of the circular cross-sectional profile, of which two concentric circles the radiuses correspond to ⅓ and ⅔ of the radius of the circular cross-sectional profile of the polyester filament, respectively, both a improved winding performance and a satisfactory residual elongation of the polyester filament yarn can be obtained.

The present invention was completed on the basis of the above-mentioned finding.

The background of the present invention will be further explained below.

The above-mentioned European Patent Publication No. 47464-A discloses such a concept that a polyester filament yarn having an increase in residual elongation (I) of 50% or more can be obtained by melt-extruding a mixture of a polyester resin with a filament elongation-enhancing agent in the form of fine particles serving as rollers or runners for the molecular orientation of the individual polyester filaments in the resultant filament yarn, and in an amount of 0.5 to 4% by weight based on the weight of the polyester resin, and by taking up the melt-extruded filament yarn at a speed of 2,500 to 8,000 m/minute along a spinning line. Also, the European publication discloses, as only one practical filament elongation-enhancing agent, ⌈DELPET 80N⌋ having an actually measured thermal deformation temperature (T) of 98° C.

In the present invention, the filament elongation-enhancing agents are limited to ones having a thermal deformation temperature (T) of 105° C. to 130° C., and thus the problems which could not be solved by the invention of the European publication, namely the difficulty in winding, can be solved.

In the polyester filament yarn of the present invention, the filament elongation-enhancing agent particles are incompatible with the polyester resin. Thus, in the melt-extruding step, the filament elongation-enhancing agent particles and the polyester resin are present in the state of a melt of a islands-in-a sea type mixture in which the islands consisting of the filament elongation-enhancing agent particles are dispersed in the sea consisting of the polyester resin, and the islands-in-a sea type mixture melt is extruded through a spinneret, and in the taking-up step, the extruded filamentary streams are drafted and cooled, to form a polyester filament yarn. During the cooling, the filament elongation-enhancing agent particles are changed from a melt state to a glass state prior to the transition of the polyester resin, and thus predominantly serve as a resisting material against the elongate-deformation of the extruded filamentary stream due to the melt-spinning stress. Due to this fact, the elongation viscosity of the mixture melt located close to the spinneret in the high polymer temperature state does not follow the common elongation viscosity formula, and a non-linear increase in the viscosity is developed. This non-linear increase in the viscosity is considered to promote the thinning of the melt-spun filament yarn at a upstream point closer to the spineret and to allow the speed of the melt-spun filament yarn to reach the final winding speed thereof, at the earlier stage of a spinning line. In other words, the thinning of the these filament yarn of the present invention is completed at a location of the melt-spun filament yarn path upstream to the location at which the thinning of a polyester filament yarn containing no filament elongation-enhancing agent and melt-spun at the same speed as above is completed.

Also, the melt-spun filament yarn of the present invention does not exhibit a thinning behavior in the form of a necking phenomenon which thinning is often observed at a taking-up speed of 4,000 to 5,000 m/minute and accompanies a crystallization of the polyester resin. From this fact, it is clear that the employment of the specific filament elongation-enhancing agent in the present invention enables the high speed melt-spinning for the polyester filament yarn to be able to effect under a low tension, the winding performance of the resultant polyester filament yarn to be improved, and a polyester filament yarn having a satisfactory residual elongation to be produced.

The polyester filament yarn of the present invention is produced by melt-spinning a mixture of a polyester resin with particles of a filament elongation-enhancing agent in an amount of 0.5 to 4%, based on the weight of the polyester resin, and by taking up the melt-spun polyester filament yarn at a speed of 2500 to 8000 m/minute.

The polyester filament yarn of the present invention exhibits an increase (I) in residual elongation of 50% or more as usual exerted to the polymer of extruded filaments determined in accordance with the equation (1):

$$I(\%)=[(EI_b/EL_o)-1)\times 100 \quad (1)$$

In the equation (1), I represents the increase in residual elongation in % of the polyester filament yarn, $EI_b$ represents a residual elongation in % of the polyester filament yarn and $EL_o$ represents a residual elongation in % of a comparative polyester filament yarn produced by the same procedures as those for the polyester filament yarn except that no filament elongation-enhancing agent is contained in the comparative polyester filament yarn.

The requirements (a), (b) and (c) which characterize the present invention will be explained below.

Requirement (a)

In view of the function of the resisting material against elongate-deformation due to the melt-spinning stress, the filament elongation-enhancing agent transits from a melt state to a glass state prior to the transition of the polyester polymer matrix during the thinning process of a melt-extruded filamentary stream. For this requirement, the filament elongation-enhancing agent of the present invention must have a thermal deformation temperature (T) of 105 to 130° C., preferably 110 to 130° C. Usually, the polyester resin has a thermal deformation temperature of about 70° C., and thus the thermal deformation temperature of the filament elongation-enhancing agent of the present invention is about 35° C. to about 60° C. above that of the polyester resin. Thus, during the melt-spinning procedure, the particles of the filament elongation-enhancing agent superiorly bear the melt-spinning stress and are concentrated in a relatively deep inner portion of each extruded filamentary stream which are being thinned. Therefore, the number of the particles exposed to the peripheral surface of each constituent filament of the resultant polyester filament yarn is decreased and, therefore the winding performance is significantly improved. When the thermal deformation temperature (T) is lower than 105° C., the resultant particles of the filament elongation-enhancing agent exhibit a malfunction, as a resisting material against the elongate-deformation of the filament yarn. Namely, since the difference in the thermal deformation temperature (T) between the filament elongation-enhancing agent and the polyester resin matrix is too small, the particles of the filament elongation-enhancing agent cannot serve as a satisfactory stress-bearing material while a large number of the particles are exposed to the surface of each filament to cause the filament surface exhibits a decreased friction coefficient, and thus the winding performance of the resultant filament yarn is significantly deteriorated. Also, when the thermal deformation temperature is higher than 130° C., the resultant filament elongation-enhancing agent particles exhibit too high a resistance to the elongate-deformation of each extruded filamentary stream. As a result, the resultant polyester filament yarn exhibits a excessive residual elongation; the mechanical strength of the polyester filament yarn becomes lower than a satisfactory level for practical use; the particles of the filament elongation-enhancing agent exhibit a lower thinning (elongating) property than that of the polyester resin during the thinning process of a melt-extruded filamentary stream and thus as a whole, the polyester resin mixture containing the filament elongation-enhancing agent exhibit an unsatisfactory filament-forming property and a stable melt-spinning operation cannot be expected.

In the following description, in place of the term "filament elongation-enhancing agent in the form of particles", a term "resisting material against elongate-deformation" or "stress-bearing material", may be employed.

Requirement (b)

In the present invention, the requirement (b) is very important to obtain both a satisfactory winding performance and a high elongation of the resultant filament yarn. As mentioned above, the stress-bearing material in each filamentary thinning polymer stream tends to concentrate in the inner portion of the filamentary polymer stream. Also, it is assumed that when the stress-bearing material is present in the surface portion of the filamentary polymer stream, the stress-bearing material is cooled in a higher cooling rate than that of the polymer itself in the extruded filamentary stream. As a result, the extruded filamentary stream exhibits an increased elongation viscosity, and, accordingly the stress-bearing effect can be exhibited with a high efficiency.

However, when the stress-bearing material in the form of particles is located on the peripheral surface of each filament, the filament surface is roughened, and the friction coefficient between individual filaments decreases. Therefore, the resultant filament yarn exhibit a very poor winding performance, and thus a filament yarn having both an improved winding performance and a high elongation cannot be obtained.

According to the present invention, the distribution of the filament elongation-enhancing particles in each filament is restricted to such an extent that while the particles are allowed to locate close to the peripheral surface of the filament, and, further the distribution density of the particles exposed to the peripheral surface of the filament is limited to as little as possible.

Namely, in the polyester filament yarn of the present invention, the filament elongation-enhancing agent distributed in each filament must satisfy the requirement (b).

With respect to the requirement (b), when an embodiment of the polyester filament of the present invention is, as shown in FIG. 1, in a circular non-hollow filament form and has a cross section surrounded by a circular outermost contour 1, and provided that the cross-section of the circular non-hollow polyester filament is divided into three areas, namely an outer annular area C defined between a pair of concentric circular outermost contour 1 and intermediate contour 3, an intermediate annular area B defined between a pair of concentric circular intermediate contour 3 and inside contour 5, and an inside circular area A surrounded by the inside circular contour 5, and that the radius of the inside circular contour 5 has a radius substantially equal to ⅓ of the radius r of the outermost circular contour 1, and the intermediate circular contour 3 has a radius substantially equal to ⅔ of the radius r of the outermost circular contour 1, the distribution density of the filament elongation-enhancing agent particles in the polyester filament is maximized in the intermediate annular area B. With regard to the extent of this maximized state, it is preferable that at least 50%, by weight, of the total amount of the filament elongation-enhancing agent dispersed in each filament is exposed in the area B.

Figure 2:
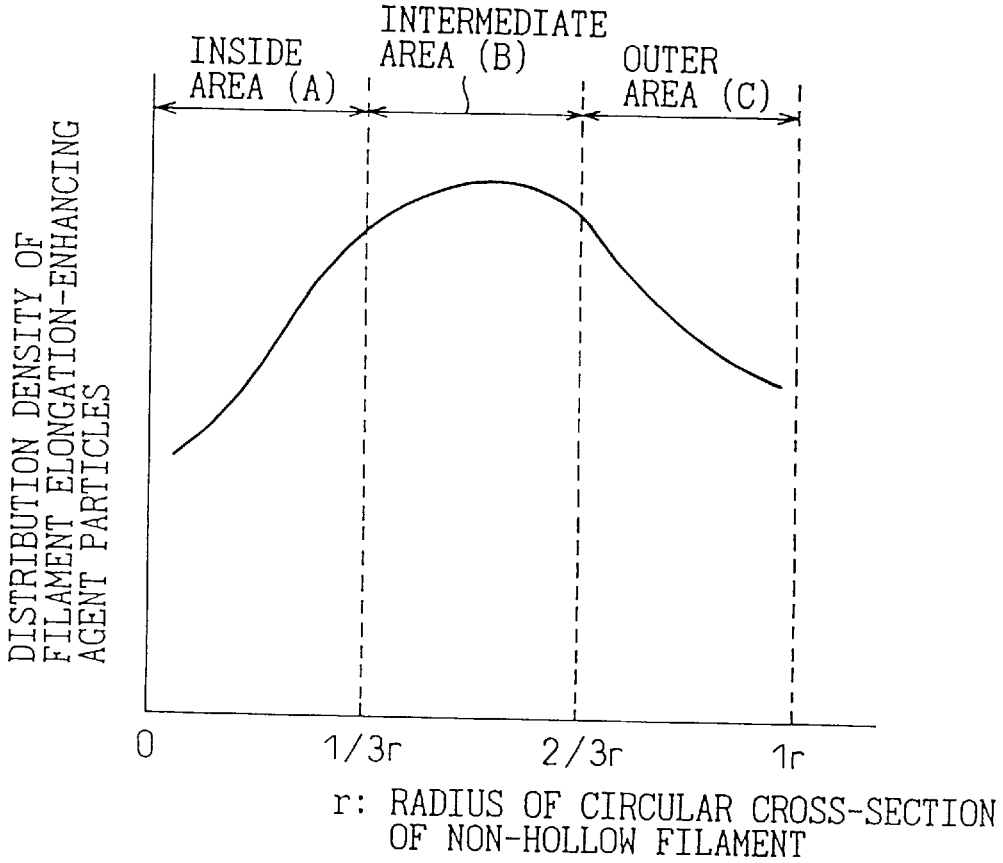
FIG. 2 is a graph showing the distribution density of the particles of the filament elongation enhancing agent in the areas A, B and C, respectively, of the filament shown in FIG. 1.

In the non-hollow circular polyester filament for the polyester filament yarn of the present invention, a relationship between the distribution density of the filament elongation-enhancing agent particles and a distance from the center point O of the cross-section of the filament is shown in FIG. 2. In FIG. 2, the distribution density of the filament elongation-enhancing agent particles is maximized in the intermediate area B which is defined between an intermediate circular contour having a radius of ⅔r and an inside circular contour having a radius of ⅓r.

Figure 3:
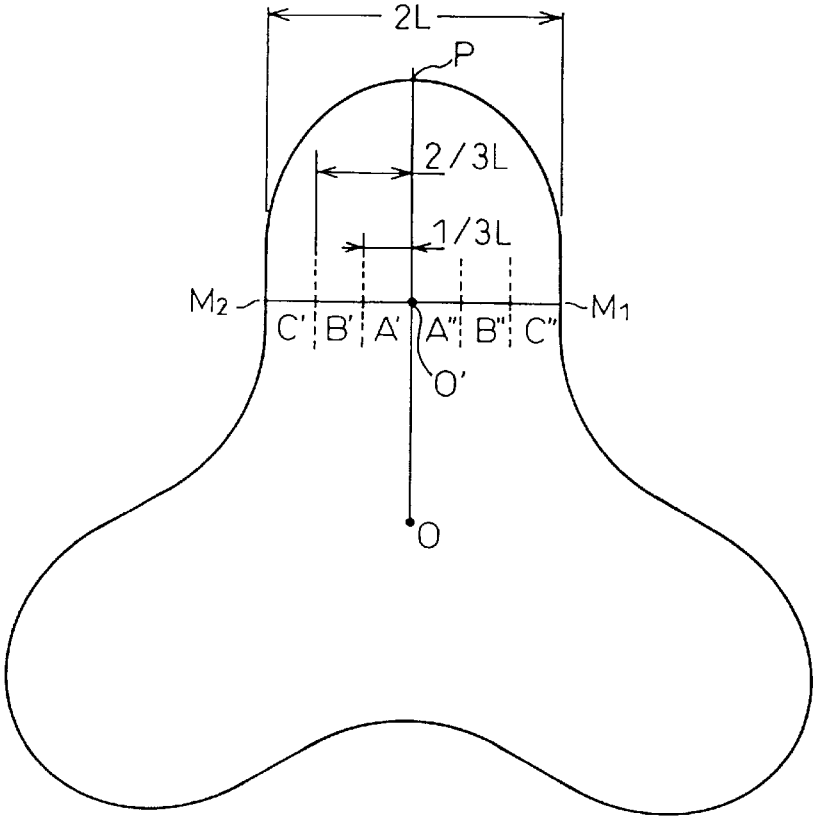
FIG. 3 shows a cross-section of an irregular non-hollow filament for the polyester filament yarn of the present invention, having areas A', B', and C'.

In another embodiment, when the polyester filament is, as shown in FIG. 3, in a non-hollow trilobal filament form and has a cross section surrounded by a outermost trilobal contour 1', a straight line O-P is drawn between the center point O and a top end point P of each lobe, and another straight line $M_1$-$M_2$ is drawn at right angles to the straight line O-P through a center point O' of the straight line O-P. Further along the straight line $M_1$-$M_2$, each lobe is divided into six areas C', B', A', A", B" and C" in parallel to the straight line O-P, and the widths of the areas C', B', A', A", B" and C" are equal to each other.

And, when the length of the straight line $M_1$-$M_2$ is represented by 2L, each of the areas C', B', A', A", B", C" has a width of ⅓L, and the total width of the areas B' and A' is ⅔L.

Figure 4:
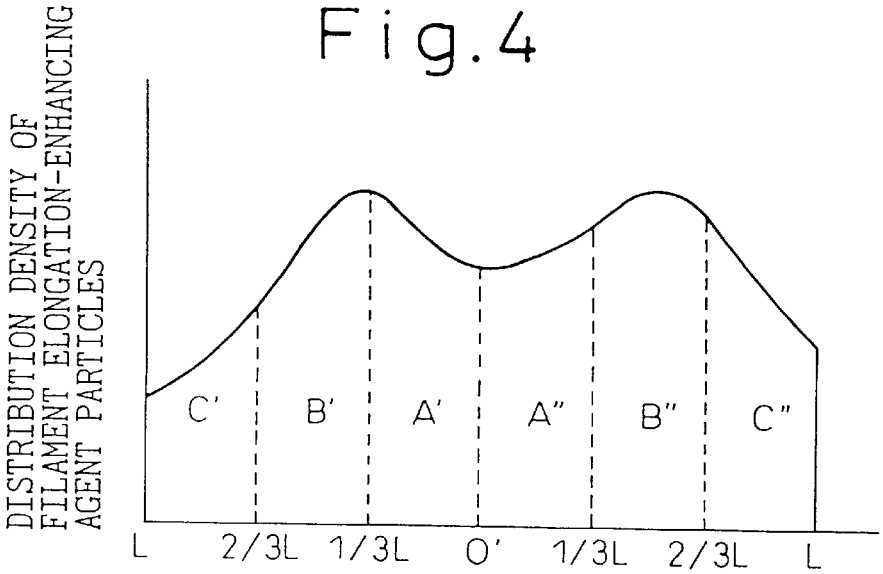
FIG. 4 is a graph showing the distribution density of the particles of the filament elongation-enhancing agent in the areas C', B', A', A", B" and C", respectively, of the filament shown in FIG. 3.

The distribution density, occurring to the present invention, of the filament elongation-enhancing agent particles is maximized in the intermediate areas B' and B", as shown in FIG. 4. In the graph shown in FIG. 4, the curve showing the relationship between the distance from the center point O' of the straight line $M_1$-$M_2$and the distribution density of the particles, has two peaks located in the intermediate areas B' and B".

Figure 5:
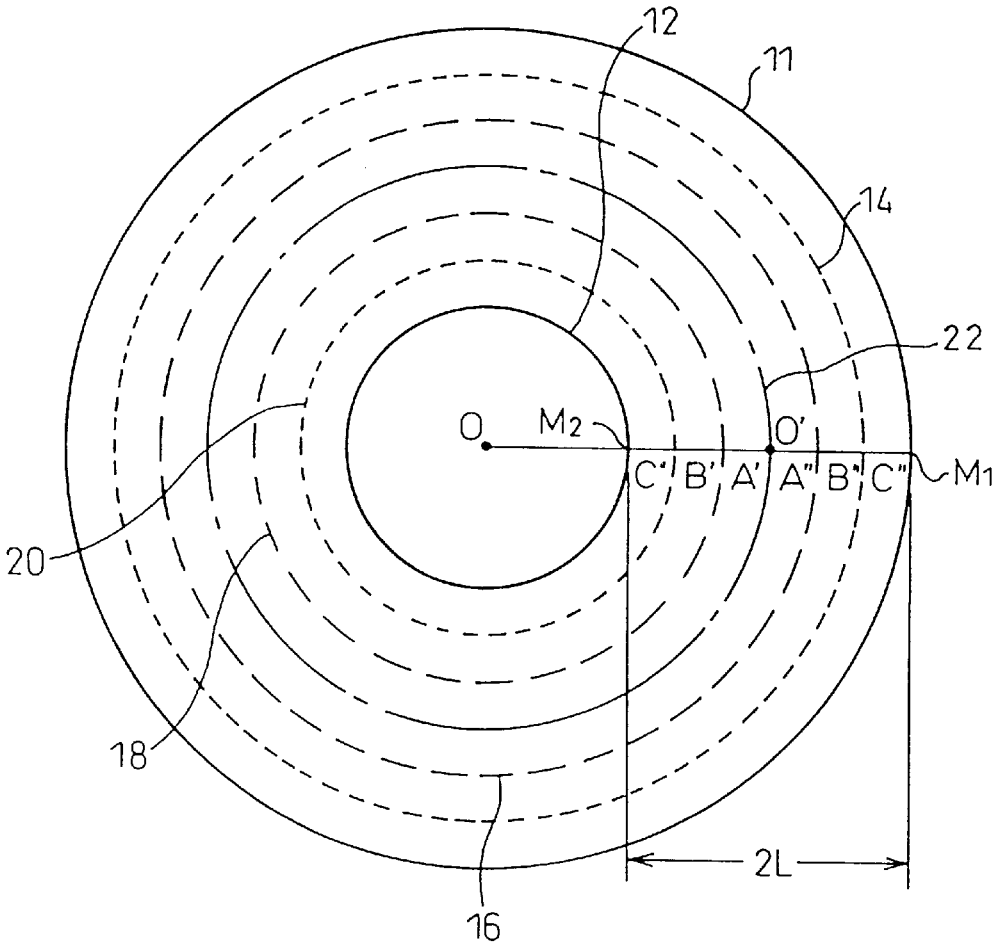
FIG. 5 shows a cross-section of a circular hollow filament for the polyester filament yarn of the present invention, having areas A", B" and C".

Further in still another embodiment, the polyester filament is, as shown in FIG. 5, in a hollow circular filament form and has a hollow circular cross-section defined by a pair of concentric circular outermost contour 11 and innermost contour 12. In FIG. 5, a straight line passing through a center point O of the concentric circular outermost contour 11 and innermost contour 12 is drawn. This straight line intersects the outermost contour 11 at a point $M_1$ and the innermost contour 12 at a point $M_2$. The straight line $M_1$-$M_2$ has a center point O'. Namely the length $M_1$-O' is equal to the length $M_2$-O'. A middle circle 22 through the center point O' is drawn around the center point O. The middle circle 22 is concentric to the outermost and innermost circular contours 11 and 12. Provided that the hollow circular cross section of the polyester filament is divided into six annular areas, namely an outermost annular area C" defined between a pair of concentric circular outermost contour 11 and first intermediate contour 14, a first intermediate annular area B" defined between a pair of concentric circular first intermediate contour 14 and first inside contour 16, an first inside annular area A" defined between a pair of concentric circular first inside contour 16 and middle circle 22, a second inside annular area A' defined between the concentric middle circle 22 and second inside contour 18, a second intermediate annular area B' defined between a pair of concentric circular second inside contour 18 and second intermediate contour 20, and an innermost annular area C' defined between a pair of concentric circular second intermediate contour 20 and innermost contour 12, and that the widths of the areas C', B', A', A", B" and C" are substantially equal to each other, the distribution density, according to the present invention, of the filament elongation-enhancing agent particles in the hollow circular polyester filament is maximized in the first and second intermediate annular areas B' and B".

Contrary to the above, when the filament elongation-enhancing agent particles are distributed in the highest distribution density in the inside area A of a non-hollow polyester filament as shown in FIG. 1 or in the inside areas A' and A" of a hollow polyester filament as shown in FIG. 5, the resultant polyester filament yarn exhibits a unsatisfactory elongation. Also, when the filament elongation-enhancing agent particles are distributed in the highest distribution density in the outer area C of a non-hollow polyester filament as shown in FIG. 1 or in the outermost area C" and/or the innermost area C' of a hollow circular polyester filament as shown in FIG. 5, the surface portions of the resultant outer area C of the non-hollow polyester filament and the resultant outermost area C" and/or innermost area C' of the hollow polyester filament exhibit too high an apparent elongation viscosity. This causes, in the non-hollow polyester filament, a skin-core structure which is unacceptable to subsequent processing. Also, in the hollow polyester filament, a skin-core-skin structure is found. Thus, a major portion of the particles of the filament elongation-enhancing agent is exposed to the outer surface of the non-hollow polyester filament or the outer and inner surfaces of the hollow polyester filament, and the winding performance of the resultant polyester filament yarn is deteriorated, although the yarn exhibits an satisfactory residual elongation. Also, the resultant polyester filament yarn exhibits a reduced mechanical strength, and a poor process performance in the subsequent processings. Further, the initial yield strength of the resultant polyester filament yarn is likely to be lowered in a dying operation, and, therefore, a finished woven or knitted fabric produced from the polyester filament yarn exhibits an insufficient bulkiness and an unsatisfactory hand.

Requirement (c)

In requirement (c), the number (N) of the filament elongation-enhancing agent particles appearing on the peripheral surface of the individual filaments constituting the yarn of the present invention must be 15 particles/100 $\mu m^2$ or less, preferably 10 particles/100 $\mu m^2$ or less.

In this feature, the number of the filament elongation-enhancing agent particles exposed to the peripheral surface of the individual filaments constituting the yarn of the present invention is limited to a small number of 15 or less per 100 $\mu m^2$ of the peripheral surface.

When the particle number (N) is more than 15 particles/100 $\mu m^2$, the peripheral surface of the resultant filament exhibit a significantly decreased frictional coefficient, and thus the resultant polyester filament yarn comprised of such filaments exhibits a poor winding performance. Also, since the filament elongation-enhancing agent particles are different in dyeing property from the polyester resin, the particles exposed in a particle number N more than 15 particles/100 $\mu m^2$ to the peripheral surface of the filament causes the dyed filament surface to exhibit an significant unevenness in color hue and/or color density, and the thus finished woven or knitted fabric comprising the dyed filament yarn reveals an unsatisfactory quality. And, further, when the filament elongation-enhancing agent particles having a high thermal deformation temperature cover the peripheral surfaces of the individual filaments at the density of more than 15 particles/100 $\mu m^2$, in the polyester filament yarn, the pre-heating efficiency decreases in thermal processings, for example, a heat-drawing process, in which process the uniform drawing is no longer expected and also undesirable fluffs are generated on the yarn.

The polyester filament yarn of the present invention satisfying the requirements (a), (b) and (c) has a high resistance to fluff formation and to filament or yarn breakage during the subsequent processes and can be stably wound around a roll or bobbin to form a yarn package while maintaining the ultimate elongation of the yarn at a high level.

In relation to the above-mentioned requirements (a), (b) and (c), the sizes of the filament elongation-enhancing agent particles distributed in the polyester filament in the longitudinal and transverse directions of the filament are restricted to a certain extent. The sizes of the particles will be explained below.

Average Size (D) of Filament Elongation-Enhancing Agent Particles in Transverse Direction of Filament The average size (D) of the filament elongation-enhancing agent particles in the transverse direction of the polyester filament exhibits a result of the contribution of the filament elongation-enhancing agent to the role of bearing a stress exerted on the filament during the thinning process of a melt-extruded filamentary stream.

In the polyester filament yarn of the present invention, the average size (D) of the filament elongation-enhancing agent particles determined in the transverse direction of the filament is preferably 0.05 to 0.15 $\mu m$, more preferably 0.07 to 0.13 $\mu m$.

When the average size (D) is less than 0.05 $\mu m$, the resultant particles may not be large enough to serve as a stress-bearing particles during the thinning process of a melt-extruded filamentary stream, and thus may exhibit an insufficient effect on the enhancement of the residual elongation of the resultant filament yarn. Also, the resultant small particles may be easily and superiorly exposed to the peripheral surface of the filament to cause the peripheral surface to be rough. And, thus the friction coefficient of the resultant filament surface may decrease and the resultant filament yarn may exhibit a poor winding property.

Also, when the average size (D) is more than 0.15 $\mu m$, the particles may exhibit a reduced dispersing property in the polyester resin matrix and are locally distributed in the extruded filamentary stream to cause the melt-spinning stress to be unevenly distributed on the cross-section of the extruded filamentary stream. This local distribution of the melt-spinning stress leads to the uneven spinning tension which, in term, causes the melt-spun filament yarn to rotate, and in each spinning hole in which the particles are unevenly distributed in the polymer melt, the melt viscosity and shearing stress of the unevenly mixed melt of the polymer with the particles are fluctuated and the flow of the mixed melt is disordered. Therefore, in this case, a stable melt-spinning cannot be expected.

Ratio L/D of Filament Elongation-Enhancing Agent Particles Distributed in Polyester Filament In the polyester filament yarn of the present invention, the filament elongation-enhancing agent particles serve as a stress-bearing particles during the thinning process of a melt-extruded filamentary stream, and thus the particles are elongated and orientated in the longitudinal direction of the filament.

In the polyester filament yarn of the present invention, the particles of the filament elongation-enhancing agent distributed in the filament preferably have a ratio L/D of 20 or less, more preferably 5 to 12, wherein L represents an average length of the particles determined in the longitudinal direction of the filament, and D represent the average size of the particles determined in the transverse direction of the filament as explained above. When the ratio L/D is more than 20, this high ratio may be one derived from the fact that the particles of the filament elongation-enhancing agent are deformed under a melt-spinning stress, while being accompanied with the deformation of the polyester resin melt, and thus the location at which the thinning of the melt-spun filament yarn is completed may not shift close to the spinneret, and the filament elongation-enhancing agent may not satisfactorily enhance the residual elongation property of the resultant polyester filament yarn.

Apart from the above in the polyester filament yarn of the present invention, three is a relationship between the residual elongation increase (I) of 50% or more and the birefringence of the polyester filament yarn. The birefringence (Δn) of the polyester filament yarn of the present invention is preferably in the range of from 0.015 to 0.105, more preferably from 0.03 to 0.070.

In the polyester filament yarn of the present invention produced at a taking up speed of 2500 to 8000 m/minute, when the birefringence (Δn) is less than 0.015, the resultant polyester filament yarn may be disadvantageous in that the physical properties of the polyester filament yarn easily change with lapse of time, and thus the drawing property is easily deteriorated. As a result, the individual filaments is likely to be frequently broken in the subsequent drawing operation, which leads to the difficulty to conduct said operation under stable conditions.

Also, when the birefringence (Δn) is more than 0.105, since the residual elongation of the resultant polyester filament yarn may be low and thus the maximum draw ratio of the melt-spun filament yarn may approach the volume of 1.0, the resultant polyester filament yarn is not suitable to various yarn processings. However, the high birefringence melt-spun polyester filament yarn may be usable, as a high speed melt-spun filament yarn, in place of drawn yarns obtained under a separate drawing system or high speed coupled spinning and drawing system, for the production of woven or knitted fabrics.

When the birefringence (Δn) is in the range of from 0.03 to 0.070, the resultant polyester filament yarn may exhibit a high residual elongation and an excellent processing performance.

The polyester resin usable for the present invention includes filament-forming polyesters in which at least one aromatic dicarboxylic acid is contained as an acid component. For example, the polyester resin comprises at least one member selected from polyethylene terephthalate resins, polytrimethylene terephthalate resins, polytetramethylene terephthalate resins, polycyclohexanedimethylene terephthalate resins, and polyethylene-2,6-naphthalene dicarboxylate resins. These polyester resins may be modified by copolymerizing with, as a third component, a diol compound, for example, butane diol, and/or a dicarboxylic acid, for example, isophthalic acid. Also, the above-mentioned polyester resins may be employed alone or in a mixture of two or more thereof. Among these polyester resins, the polyethylene terephthalate resins are more preferably employed for the present invention.

The polyester resin for the present invention optionally contains an additive comprising at least one member selected from delustering agents, thermal stabilizers, ultraviolet ray-absorbers, anti-static agents, end group-stopping agents and fluorescent brightening agents.

In view of the melt-spinning property of the polyester resins and the physical properties of the polyester filament yarn, the polyester resin preferably has an intrinsic viscosity of 0.4 to 1.1, determined in o-chlorophenol at a temperature of 35° C.

The filament elongation-enhancing agent usable for the present invention comprises at least one polymeric material produced by an addition polymerization of at least one unsaturated monomer, especially ethylenically unsaturated monomer, and substantially incompatible with the polyester resin.

The filament elongation-enhancing agent has a thermal deformation temperature (T) of 105 to 130° C., preferably 110 to 130° C., as mentioned above.

The filament elongation-enhancing agent preferably comprises at least one member selected from acrylonitrile-styrene copolymers, acrylonitrile-butadiene-styrene copolymers, polytetrafluoroethylenes, high density polyethylenes, low density polyethylenes, straight linear low density polyethylenes, polystyrenes, polypropylenes, polymethylpentenes, polyacrylate ester resins, polymethyl methacrylate resins, and derivatives of the above-mentioned polymers.

These polymers for the filament elongation-enhancing agent is necessary, dependently from the polyester resin, to exhibit a structural viscoelasticity high enough to serve as a stress-bearing high molecular material during the thinning process of a melt-extruded filamentary stream. Thus, the filament elongation-enhancing agent has a high molecular weight. Namely, the filament elongation-enhancing agent preferably has a weight average molecular weight of 2000 or more, more preferably 2,000 to 200,000, still more preferably 8,000 to 150,000.

When the molecular weight is less than 2,000, the resultant filament elongation-enhancing agent may not exhibit a structural viscoelasticity high enough to serve as a stress-bearing high molecular material. Also, when the molecular weight is more than 200,000, the resultant polymer may exhibit too high a cohesive energy and thus the melt viscosity of the polymer may be too high for the polyester resin. Therefore, the resultant filament elongation-enhancing agent particles may be very difficult to evenly disperse in the polyester resin matrix, and thus the melt mixture of the polyester resin and the filament elongation-enhancing agent particles may exhibit a significantly reduced filament-forming property and the resultant filament yarn may be difficult to smoothly wind. Further, the resultant filament elongation-enhancing agent particles may exhibit a high negative effect on the polyester resin and it may be impossible to obtain the polyester filament yarn having a satisfactory physical properties.

When the weight average molecular weight is in the range of from 8,000 to 150,000, the resultant filament elongation-enhancing agent exhibit an enhanced thermal resistance and thus is very useful for the present invention.

The addition polymerization product usable for the filament elongation-enhancing agent is preferably selected from methyl methacrylate copolymers and isotactic styrene polymers each having a weight average molecular weight of 8,000 to 200,000 and a melt index (M.I.) of 0.5 to 15.0 g/10 minutes determined in accordance with Japanese Industrial Standard (JIS) D 1238 at a temperature of 230° C. under a load of 3.8 kgf, methyl pentene polymers and derivatives thereof having a weight average molecular weight of 8,000 to 200,000 and a melt index (M.I.) of 5.0 to 40.0 g/10 minutes determined in accordance with JIS D 1238 at a temperature of 260° C. under a load of 5.0 kgf, and syndiotactic (crystalline) styrene polymers and derivatives thereof having a weight average molecular weight of 8,000 to 200,000 and a melt index (M.I.) of 6.0 to 25.0 g/10 minutes determined in accordance with JIS D 1238 at a temperature of 300° C. under a load of 2.16 kgf. The above-mentioned polymers have excellent thermal stability and dispersing property in the polyester resin matrix, at a melt-spinning temperature for the polyester resin mixture.

In an embodiment of the polyester filament yarn of the present invention, the addition-polymerization product of the unsaturated organic monomer comprises an acrylate polymer comprising, as a principal component, an addition-polymerized methyl methacrylate and having a number average molecular weight of 8,000 to 200,000 and a melt index of 0.5 to 8.0 g/10 minutes, determined at a temperature of 230° C. under a load of 3.8 kg.

In another embodiment of the polyester filament yarn, the addition-polymerization product of the unsaturated organic monomer comprises a styrene polymer comprising, as a principal component, an isotactic styrene polymer and having a number average molecular weight of 8,000 to 200,000 and a melt index of 0.5 to 8.0 g/10 minutes, determined at a temperature of 230° C. under a load of 3.8 kg.

In still another embodiment of the polyester filament yarn, the addition-polymerization product of the unsaturated organic monomer comprises a styrene polymer comprising, as a principal component, a syndiotactic (crystalline) styrene polymer and having a number average molecular weight of 8,000 to 200,000 and a melt index of 6 to 2.5 g/10 minutes, determined at a temperature of 300° C. under a load of 2.16 kg.

In further embodiment of the polyester filament yarn, the addition-polymerization product of the unsaturated organic monomer comprises a methylpentene polymer comprising, as a principal component, an addition polymerized 4-methylpentene-1 and having a number average molecular weight of 8,000 to 200,000 and a melt index of 5.0 to 40.0 g/10 minute determined at a temperature of 260° C. under a load of 5.0 kg.

The process of the present invention for producing the polyester filament yarn as mentioned above will be explained below.

To obtain the polyester filament yarn of the present invention having the excellent winding performance and the high residual elongation, the process for producing the polyester filament yarn comprises, as important steps, a specific filtering procedure for the melt of the mixture of the polyester resin and the filament elongation-enhancing agent particles under a specific drafting procedure for the melt-spun filament yarn.

In the process of the present invention, a melt of a mixture of a polyester resin and particles of a filament elongation-enhancing agent in an amount of 0.5 to 4.0%, by weight, based on the weight of the polyester resin is melt-extruded through a spinneret, and the melt-extruded polyester filament yarn is taken up at a speed of 2500 to 8000 m/minute.

In this process, it is important that in the melt-extruding step, the melt passes through a filter having a pore size of 40 $\mu$m or less and arranged upstream to the spinneret, and in the spinning line, an apparent draft of the melt-extruded polyester filament yarn is controlled to a range of from 150 to 1,500.

When the pore size of the filter is more than 40 $\mu$m, the filtered melt mixture may include coarse particles and thus may not be stably melt-spun. Also, when the coarse particles are exposed to the periphery surface of the filament, and the resultant filament surface is roughened, the resultant filament yarn may exhibit a poor winding performance.

Also, the taking up step must be carried out under a draft of 150 to 1,500 and at a speed of 2,500 to 8,000 m/minute. When the draft is less than 150, namely the size of the melt spinning hole is small, a high shearing force is applied to the polymer melt passing through the melt-spinning hole, and thus the melted filament elongation-enhancing agent particles elongated in the longitudinal direction of the polymer melt stream are teared by the shearing force. Thus, the average size (D) of the particles in the transverse direction may become smaller than 0.05 $\mu$m. Therefore, the particles of the filament elongation-enhancing agent may exhibit an unsatisfactory elongation-enhancing effect on the filament. Namely, the particles do not exhibit a satisfactory stress-bearing effect on the melt-spun filament, a frequency of exposing the particles to the peripheral surface of the filament increases, and the resultant polyester filament yarn exhibits an unsatisfactory winding performance.

Also, when the draft is more than 1,500, the tearing effect on the filament elongation-enhancing agent particles by the shearing force applied to the particles during passing through the melt-spinning hole is low and the residual elongation of the melt-spun filament yarn is significantly enhanced. However, the high draft exceeding 1500 causes the coarse particles to be generated and the coarse particles in turn cause the winding property of the resultant filament yarn to become poor.

Accordingly, when the draft is in the range of from 150 to 1,500, the distribution of the particles of the filament elongation-enhancing agent in the resultant polyester filament can satisfy the requirement (b) of the present invention, as shown, for example, in FIG. 2 for the non-hollow circular filament or in FIG. 4 for the non-hollow trilobal filament. Namely, the distribution density of the filament elongation-enhancing agent particles are distinctly maximized in the intermediate area B, or B' and B", and the melt-spinning procedure can be smoothly effected in a stable condition. When the process of the present invention is carried out, the particles of the filament elongation-enhancing agent are elongated in the longitudinal direction of the filament and thinned, while bearing the melt-spinning stress, to decrease the particle size in the transverse direction to 0.05 to 0.15 $\mu$m. During the melt-spinning procedure with the draft of 150 to 1,500, the filament elongation-enhancing agent particles, which are evenly distributed throughout the melt-extruded filamentary stream at the initial stage of the melt-spinning procedure, are concentrated in the intermediate area or areas of the filament as mentioned above. This specific local distribution of the filament elongation-enhancing agent particles in the extruded filamentary stream causes the resultant polyester filament yarn to exhibit both a satisfactory residual elongation and an improved winding performance.

In the process of the present invention, the melt-spinning temperature (which is identical to the temperature of the spinneret) and the cooling of the melt-extruded filamentary stream at a location downstream from the spinneret are preferably controlled.

With respect to the melt-spinning temperature, it is preferable that the spinneret temperature for the melt mixture of the polyester resin and the filament elongation-enhancing agent particles dispersed in the polyester resin matrix are maintained to a level lower than the spinneret temperature for conventional polyester resins free from the filament elongation-enhancing agent particles melt, to ensure a high increase in the residual elongation and a good and stable winding performance of the resultant filament yarn. These advantages are derived from the phenomenon that, after passing through the spinneret, the filament elongation-enhancing agent particles exhibit a high elongation viscosity in a upstream portion of the melt-spun filament yarn path, and serve as a melt-spinning stress-bearing agent. As a result, the melt-spinning tension of the filament yarn significantly decreases and a specific area as respeatedly explained above, where the filament elongation-enhancing agent particles are distributed in a maximum distribution density, is formed and fixed in the melt-spun filament. In the process of the present invention, the spinneret temperature is preferably 270 to 290° C., more preferably 275 to 285° C., when the polyester resin consist essentially of ethylene terephthalate unit. In this case, when the spinneret temperature is less than 270° C., the resultant polyester resin mixture melt may exhibit an insufficient filament-forming property, and when the spinneret temperature is more than 290° C., the filament elongation-enhancing agent may exhibit an insufficient thermal stability in the polyester resin melt.

The cooling of the melt-extruded filamentary stream downstream from the spinneret is preferably carried out by blowing cooling air at a blowing speed controlled to a range of from 15 to 0.6 m/second in the transverse direction to the same, to enhance both the residual elongation and the winding performance of the resultant polyester filament yarn.

When the air blowing speed is less than 0.15 m/second, the resultant filament yarn is uneven in quality and thus in the subsequent processings, a processed filament yarn, for example, a drawn filament yarn or a textured yarn having a high quality may not be obtained. Also, when the air blowing speed is more than 0.6 m/second, the elongation viscosity of the polyester resin melt in the melt-extruded filamentary stream may increase and thus the increase in the residual elongation of the resultant filament yarn may not be expected.

The addition of the filament elongation-enhancing agent particles to the polyester resin can be effected by conventional methods. For example, during the polymerization process of the polyester resin, the particles are mixed to a polyester resin in a final stage of the polymerization process. In another method, the polyester resin and the filament elongation-enhancing agent particles are melted and mixed with each other, the resultant melt mixture is extruded, cooled and cut to form chips (or pellets) of the mixture. In still another method, a polyester resin melt is fed through a main conduit, and a melt of the filament elongation-enhancing agent is also fed through a side conduit connected to the main conduit, both into a spinning block after passing through dynastic and/or static mixer. In still another method, the polyester resin and the filament elongation-enhancing agent both in the chip form are mixed with each other, and the mixture is fed to a spinneret. Among those methods, a method in which a portion of a polyester resin melt charged in a feed line to a directly connected to spinning block is withdrawn on the way and is melt-mixed with the filament elongation-enhancing agent particles to disperse them in the polyester resin melt, the resultant melt mixture is returned into the feed line through dynamic and/or static mixer, and then subjected to melt-spinning, is most preferred.

In the process of the present invention, since lowered tension is exerted on the polymer portion in the extruded filamentary stream while the filament elongation-enhancing agent particles in the mixture functions as a tension-bearing element, a polyester filament yarn having an extremely small thickness of 1.11 dtex per filament (1.0 denier) or less can be produced at a high taking up speed.

Generally speaking, in the production of a polyester filament yarn of which the individual filament thickness is extremely small, since the cooling of the melt-extruded filamentary stream is effected at a very high speed, and an air resistance per unit cross-sectional area of the filament yarn, occurred at a location upstream to a first godet roll is high, the production efficiency of the extremely fine filaments at a high taking up speed is low and the production yield thereof is very poor. However, when the specific polyester resin mixture of the present invention is used, the enhancement of the cooling effect due to decrease in the individual filament thickness cause the orientation and crystallization-obstruction effect to be promoted, and this effect is advantageous for the production of the extremely fine filaments and enables the production of the same at a high speed.

The above-mentioned melt-spinning method of the present invention can be applied to not only the production of the as-spun type polyester filament yarn alone, but also the production of other types of filament yarns.

For example, by co-melt-extruding (co-spinning) a polyester resin mixture containing the filament elongation-enhancing agent particles and a polyester resin containing substantially no filament elongation-enhancing agent particles independently through a common spinneret, a mixed undrawn polyester filament yarn having the elongation properties similar to such a mixed undrawn polyester filament yarn as produced by doubling two kind undrawn polyester filament yarns separately taken up at the different taking up speed and thus different in the ultimate elongation from each other, can be directly taken up and wound.

In the conventional co-melt-spinning method, a single polyester resin melt is extruded through a spinneret having two types of spinning holes extremely different in diameter from each other. In this case, the taking up speed should be controlled to a low level of about 1500 m/minute to obtain a melt-spun polyester filament yarn having a high residual elongation, for example, a high ultimate elongation of 270 to 340%. Compared with this, when the polyester resin mixture melt containing the filament elongation-enhancing agent particles and the polyester resin melt substantially free from the particles are independently extruded through the common spinneret, the resultant mixed polyester filament yarn can be taken up and wound at a high taking up speed at which the polyester filament yarn produced from the polyester resin free from the filament elongation-enhancing agent and having a desired low residual elongation can be taken up. Therefore, the co-melt-spinning method of this type contributes to enhancing the productivity of the mixed polyester filament yarn.

The mixed polyester filament yarn consisting of two types of polyester filament yarns different in residual elongation from each other can be advantageously employed as a material yarn for a core-in-sheath type composite false-twisted bulky yarn disclosed, for example, in U.S. Pat. No. 2,013,746 (corresponding to JP-B-61-19,733). Namely, when the above-mentioned material yarn is subjected to a simultaneous draw-false twisting procedure in accordance with the process as disclosed in the above-mentioned U.S. patent, a high draw ratio can be applied to the material yarn, and thus the resultant drawn and false-twisted yarn can be taken up and wound at an increased speed, to enhance the productivity of the processed yarn.

The melt spinning process of the present invention can be preferably combined with a conventional sequential melt-spinning and drawing process. Particularly, when a high speed/high performance winder by which a high winding speed (peripheral speed) of 8,000 m/minute or more can be realized, is employed, the polyester filament yarn can be taken up by a taking up roller G1 (which serves as a pre-heating roller and which is referred as a first godet roller) at a taking up speed of 5,000 to 6,000 m/minute, and then drawn and heat set by a draw-heat setting roller G2 (which is referred as a second godet roller) at a speed of 7,000 to 9,000 m/minute. Also, the melt-spinning process of the present invention can be utilized for an energy-saved polyester filament yarn-producing process in which the first godet roller (G1) is drived at a speed of 7,000 to 8,000 m/minute, then the filament yarn is cold-drawn by the second godet roller (G2) at a speed ratio ($G_2/G_1$) of the second godet roller (G2) to the first godet roller (G1) of 1.10 to 1.25 at highest, the drawn filament yarn passes through a steam chamber to remove the residual strain of the filament yarn and to heat set the same, and then the heat set filament yarn is wound.

EXAMPLES

The present invention will be further illustrated by the following examples.

In the examples, the following tests were applied to the resultant polyester filament yarns.

(1) Thermal deforming temperature (T)

The thermal deformation temperature of the polyester filament yarn was measured in accordance with ASTM D-648.

(2) Average size (D) of filament elongation-enhancing agent particles in transverse direction A sample of the melt-spun filament yarn was embedded in a parafin matrix, and was cut at right angles to the longitudinal axis of the yarn to prepare specimens having a thickness of 7 $\mu$m for electron microscopic observation by an electron microscope (model: JSM-840, made by NIPPON DENSHI K.K.). A plurality of the specimens were placed on a slide glass and left in toluene at room temperature for two days. During this treatment, the particles of the filament elongation-enhancing agent consisting of an addition polymerization product of an unsaturated monomer were dissolved in toluene and removed from the specimens. Onto the resultant specimens, platinum was deposited by sputtering at 10 mA for 2 minutes, and the platinum deposited specimens were photographed at a magnification of 15,000. In the resultant photograph, cross-sectional areas of 200 traces of the particles were measured by an area curve meter (made by K.K. USHIKATA SHOKAI) and an average size of the traces in the transverse direction of the filament yarn was calculated. The resultant average size represents the average particle size (D) of the filament elongation-enhancing agent particles in the transverse direction.

(3) Average size (L) of filament elongation-enhancing agent particles in longitudinal direction and a ratio L/D A sample of the melt-spun filament yarn was embedded in parafin matrix, and was cut to cut individual filaments along the longitudinal axis of each filament to prepare specimens for the electron microscopic observation. A plurality of the specimens were placed on a slide glass and left in toluene at room temperature for two days to dissolve the filament elongation-enhancing agent particles in toluene and platinum was deposited on the resultant cut filament surfaces by the same procedures as mentioned above. The platinum-deposited specimens were photographed at a magnification of 15,000. In the photograph, the lengths of 200 traces of the particles were measured by the same area curve meter as mentioned above, and average length of the traces in the longitudinal direction was calculated. The average length of the particles (L) in the longitudinal direction is represented by the average length of the traces.

Also, the ratio L/D is represented by a ratio of the average length of the traces in the longitudinal direction to the average size of the traces in the transverse direction.

(4) Distribution of the filament elongation-enhancing agent particles in cross-section of polyester filament Twenty cross-sections of a non-hollow circular polyester filament were photographed in the same manner as mentioned above. In each photograph, the circular cross section of the filament was divided into three concentric areas, namely an inside circular area surrounded by an inside contour having a radius corresponding to ⅓ of the radius of the outer circular contour of the cross-section, an intermediate annular area defined between the inside contour and an intermediate circular contour having a radius corresponding to ⅔ of the radius of the outer circular contour and an outer annular area defined between the intermediate circular contour and the outer circular contour. The number of the traces of the filament elongation-enhancing agent particles in each area was countered, and a distribution density of the traces (the number of the traces per unit area) in each area was calculated.

The percentage of the distribution density of the traces in each area to the average distribution density of the traces in the entire cross-section of the filament was calculated.

The percentage of the distribution density of the filament elongation-enhancing agent particles in each area is represented by the percentage of the distribution density of the traces in each area.

(5) The number (N) of filament elongation-enhancing agent particles appearing on peripheral surface of filament A polyester filament yarn consisting of a plurality of individual filaments was cut to a length of 10 mm, at right angles to the longitudinal axis of the filament yarn. The cut filaments were placed on a slide glass and immersed in toluene at room temperature for two days to remove the filament elongation-enhancing agent particles from the filaments. In the same manner as mentioned in the test (2), the surfaces of the filaments were photographed at a magnification of 15,000. In the photograph, the number of the traces of the particles per 2000 $\mu m^2$ was counted. From the counted number of the traces, the number of the particles per 100 $\mu m^2$ of the filament surface was calculated.

(6) Birefringence ($\Delta n$) of polyester filament yarn

Interference fringes of a polyester filament yarn was measured by a polarizing microscope using a penetration liquid consisting of 1-bromonaphthalene and a single color light with a wave length of 530 nm. The birefringence ($\Delta n$) of the polyester filament yarn was calculated in accordance with the following equation:

$$\Delta n = 530(n+\theta/180)/X$$

wherein n represents the number of the interference fringes, $\theta$ represent a rotation angle of a compensator and X represents a diameter of the filament.

(7) Residual elongation

A melt-spun polyester filament yarn was left to stand in a high temperature high humidity room maintained at a temperature of 25° C. at a relative humidity of 60% for 24 hours, then a sample of the yarn was set at a measurement length of 100 mm on a tensile tester (trademark: TENSILON, made by K.K. SHIMAZU SEISAKUSHO) and an ultimate elongation of the sample was measured at an elongation speed of 200 mm/minute, namely at a stress rate of 2 $mm^{-1}$.

The ultimate elongation represents the residual elongation of the filament yarn.

(8) Melt index

Melt index was measured in accordance with ASTM D-1238.

(9) Apparent melt spinning draft (Df)

In a melt-spinning of a polyester filament yarn, a melt-extruding rate in ml/minute of an individual filament was calculated by dividing a melt-extruding amount in g/minute of the filament with a specific gravity in g/cm$^3$ of the polyester resin melt, namely 1.2 g/cm$^2$, the resultant melt-extruding rate in ml/minute was divided with a cross-sectional area of the melt-extruding hole, to calculate a melt-extruding linear rate Vo. The Df is calculated from a taking-up (or winding) rate Vw of the filament yarn and the melt-extruding linear rate Vo in accordance with the following equation:

$$Df=Vw/Vo$$

(10) Spinneret temperature

The spinneret temperature was measured by inserting a temperature detecting end of a thermometer into a temperature measurement hole having a depth of 2 mm and formed in a surface portion of the spinneret, and measuring the temperature of the temperature measurement hole, while the spinneret is in the melt-spinning conditions.

(11) Blowing speed of cooling air downstream to the spinneret

An anemometer was arranged at a location of 30 cm far from the upper end of a cooling air-blowing vent having a honeycomb structure and adhered to the honeycomb face. The blowing speed of the cooling air was measured five times by the anemometer. An average of the measured blowing speed values was calculated.

(12) Frictional coefficient between filaments (F/F frictional coefficient)

The F/F frictional coefficient is illustrated in detail in Japanese Unexamined Patent Publication No. 48-35112, and is a barometer of sliding property of the filaments to each other.

A sample of multifilament yarn (Y) having a length of 690 m was helically wound around a cylinder having an outside diameter of 5.1 cm and a length of 7.6 cm at a helix angle of ±15 degrees under a winding load of 10 g, by using a traverse motion. A specimen ($Y_1$) of the same sample of multifilament yarn as that mentioned above having a length of 30.5 cm was placed on the wound yarn layer formed on the cylinder, in parallel to the winding direction of the yarn (Y). An end of the yarn specimen ($Y_1$) was connected to a strain gauge of a friction tester and the other end of the yarn specimen ($Y_1$) was loaded under a load of 0.04 time of the weight corresponding to the value of the thickness in denier of the yarn specimen ($Y_1$). Then the yarn (Y)-wound cylinder is rotated in an angle of 180 degrees at a periphery speed of 0.0016 cm/second. The tension exerted on the yarn specimen ($Y_1$) was continuously recorded.

The F/F frictional coefficient (f) is calculated the following equation which is well known with respect to a friction of a belt moving on a cylinder.

$$f=(1/\pi)ln(T_2/T_1)$$

wherein $T_2$ represents an average peak tensions of the yarn specimen ($Y_1$) measured 25 times, $T_1$ represents a tension applied to the yarn specimen ($Y_1$) under a load of 0.04 times of the weight corresponding to the value of the thickness in denier of the yarn specimen ($Y_1$), ln is a sign of natural logarithm. When a non reversible elongation of the yarn specimen ($Y_1$) occurred during the measurement, namely, when the yarn specimen ($Y_1$) was drawn, the data of the drawn yarn specimen were not employed. The measurement atmosphere temperature was 25° C.

(13) Oil pick up (OPU) measurement method

A sample of a melt-spun filament yarn was dried at a temperature of 105° C. for 2 hours, then immediately the weight (W) of the dried yarn was measured. Then, the yarn sample was immersed in 300 ml of an aqueous cleaning solution containing, as a principal component, sodium alkylbenzenesulfonate, and treated with ultrasonic waves at a temperature of 40° C. for 10 minutes. After the aqueous cleaning solution was removed, the cleaned yarn sample was rinsed with flowing hot water at a temperature of 40° C. for 30 minutes, and then dried at room temperature. Thereafter, the yarn sample was further dried at a temperature of 105° C. for 2 hours and immediately, the weight ($W_1$) of the dried yarn sample was measured.

The oil pick-up (OPU) of the yarn sample was calculated in accordance with the following equation:

$$OPU(\%)=[(W-W_1)/W_1]\times 100$$

(14) The number of fluffs per m

The number of fluffs appearing on a textured yarn produced by a false-twisting method and having a length of 25 m or more was counted by the naked eye, and the number of the fluffs per m was calculated.

Example 1–8 and Comparative Examples No. 1 to 6

In each of Example 1 to 8 and Comparative Examples 1 to 6, a polyester filament yarn was produced by the following procedures.

Chips of a polyethylene terephthalate resin having an intrinsic viscosity of 0.64, determined in 0-chloro phenol at a temperature of 35° C. and containing a delustering agent consisting of a titanium dioxide pigment in an amount of 0.3% based on the weight of the polyethylene terephthalate resin were dried at a temperature of 160° C. for 5 hours and were then melted in a Fullright type single screw melt-extruder having an inside diameter of 25 mm at a temperature of 300° C.

Separately, a filament elongation-enhancing agent consisting of (A) a polymethyl methacrylate (PMMA-(A)) resin having a thermal deformation temperature (T) of 121° C., a melt index of 1.0 g/10 minutes determined at a temperature of 230° C. under a load of 8 kgf, a weight average molecular weight of 150,000, or (B) a polymethyl methacrylate (PMMA-(B)) resin having a thermal deformation temperature (T) of 98° C., a melt index of 2.5 g/10 minutes determined at a temperature of 230° C. under a load of 3.8 kgf, and a weight average molecular weight of 60,000, or (C) a methyl methacrylate-acrylic imide addition product-styrene (molar ratio=24:45:30) copolymer (PMMA-(C)) resin having a thermal deformation temperature (T) of 140° C., a melt index of 0.6 g/10 minutes determined at a temperature of 230° C. under a load of 3.8 kgf and a weight average molecular weight of 70,000, was melted at a temperature of 250° C.

The melt of the filament elongation-enhancing agent was introduced in the amount shown in Table 1, through a side path, into the melt-extruder and mixed into the melt of the polyester resin in the melt-extruder. The resultant mixture was passed through a 20 step static mixer to disperse the filament elongation-enhancing agent melt in the form of a plurality of particles in a matrix consisting of the polyester resin melt. The melt mixture was filtered through a metal filament filter having a pore size of 25 μm and then melt-extruded through a spinneret arranged immediately downstream from the filter and provided with 36 melt-spinning nozzles having a diameter of 0.4 mm and land length of 0.8 mm at a spinneret temperature of 285° C. at a extruding rate controlled in response to the taking up speed as shown in Table 1. The extruded filamentary streams were cooled by blowing cooling air in the transverse direction to the longitudinal axis of the spinning line, at a blow speed of 0.23 m/second, from a transverse blow cooling pipe arranged at a location of 9 to 100 cm below the spinneret, to cool and solidify the extruded filamentary streams to provide a polyester filament yarn consisting of 36 filaments. The polyester filament yarn was oiled with an aqueous emulsion of an oiling agent in a dry amount of 0.25 to 0.30% based on the weight of the filament yarn, and then was taken up at the speed shown in Table 1. In the above-mentioned melt-spinning procedures, the draft ratio (Vw/Vo) was 407. The resultant polyester filament yarn had a yarn count of 133.3 dtex (120 denier)/36 filaments.

The oiling agent had the following composition.

| Oiling agent (Fa) | |
|---|---|
| Component | Content (% by wt.) |
| Butanol-PO/EO (50/50) random addition reaction product | 50 |
| Glycerol-PO/EO (50/50) random addition reaction product | 47 |
| Sodium alkyl ($C_{12}$–$C_{16}$) sulfonate | 1.5 |
| Pottasium EO (2 moles)-laurylphosphate | 1.5 |

[Note:
PO ... oxypropylene group
EO ... oxyethylene group]

The aqueous oiling agent emulsion had a dry content of 10% by weight and was applied to the filament yarn by using a metering oil nozzle.

In the taking up step, the tension (immediately before a winding package) was maintained in the range of from 0.15 to 0.25 time of the force corresponding to the thickness in denier of the filament yarn. The taken up filament yarn was wound into a package having a yarn weight of 7 kg. The form of the yarn package was evaluated by the naked eye into the following classes.

| Class | Package form |
|---|---|
| 3 | Satisfactory |
| 2 | Cob-webbing occurs |
| 1 | Package-bursting occurs |

The tests are shown in Tables 2 and 3.

TABLE 1

| | | Melt-spinning | | |
|---|---|---|---|---|
| | | | Filament elongation-enhancing agent | |
| Example No. | Item | Taking up speed (m/min) | Type | Amount (% wt.) |
| Comparative Example | 1 | 2000 | (A) | 1.5 |
| Example | 1 | 2500 | (A) | 1.5 |
| | 2 | 3500 | (A) | 1.5 |
| Comparative Example | 2 | 4500 | (A) | 0.3 |
| Example | 3 | 4500 | (A) | 0.5 |
| | 4 | 4500 | (A) | 1.5 |
| | 5 | 5500 | (A) | 1.5 |
| | 6 | 5500 | (A) | 3.0 |
| Comparative Example | 3 | 5500 | (A) | 5.0 |
| | 4 | 5500 | (B) | 3.0 |
| | 5 | 5500 | (C) | 3.0 |
| Example | 7 | 7000 | (A) | 1.5 |
| | 8 | 8000 | (A) | 1.5 |
| Comparative Example | 6 | 8500 | (A) | 1.5 |

TABLE 2

| | | Filament elongation-enhancing agent particles in individual filament | | | | | |
|---|---|---|---|---|---|---|---|
| | | | | Percentage of distribution density (%) | | | The number (N)(*)$_3$ |
| Item Example No. | | D(*)$_1$ μm | L/D(*)$_2$ | Inside area | Intermediate area | Outer area | (particles/100 μm$^2$) |
| Comparative Example | 1 | 0.12 | 5 | 133 | 85 | 82 | 16 |
| Example | 1 | 0.095 | 10 | 97 | 115 | 88 | 8 |
| | 2 | 0.076 | 14 | 95 | 119 | 86 | 9 |
| Comparative Example | 2 | 0.065 | 15 | 89 | 121 | 90 | 3 |
| Example | 3 | 0.068 | 13 | 87 | 120 | 93 | 4 |
| | 4 | 0.069 | 12 | 83 | 130 | 87 | 8 |
| | 5 | 0.062 | 14 | 79 | 132 | 89 | 10 |
| | 6 | 0.064 | 13 | 77 | 134 | 89 | 15 |

TABLE 2-continued

| Item Example No. | | Filament elongation-enhancing agent particles in individual filament: D(*)$_1$ μm | L/D(*)$_2$ | Percentage of distribution density (%): Inside area | Intermediate area | Outer area | The number (N)(*)$_3$ (particles/100 μm$^2$) |
|---|---|---|---|---|---|---|---|
| Comparative Example | 3 | 0.070 | 14 | 90 | 125 | 85 | 22 |
| | 4 | 0.047 | 23 | 110 | 111 | 79 | 21 |
| | 5 | 0.165 | 8 | 76 | 124 | 100 | 13 |
| Example | 7 | 0.060 | 18 | 91 | 117 | 92 | 12 |
| | 8 | 0.057 | 17 | 95 | 109 | 96 | 14 |
| Comparative Example | 6 | 0.055 | 20 | 91 | 105 | 104 | 18 |

Note:
(*)$_1$ . . . Average particle size determined in transverse direction
(*)$_2$ . . . Average particle length determined in longitudinal direction
(*)$_3$ . . . The number of particles appearing on peripheral surface of filament per 100 μm$^2$

TABLE 3

| Item Example No. | | Polyester filament yarn: Δn(*)$_4$ | Tensile strength (g/de) | Ultimate elongation (%) | Increase in residual elongation (I) (%) | Package form |
|---|---|---|---|---|---|---|
| Comparative Example | 1 | 0.0089 | 1.34 | 360 | 29 | 2 |
| Example | 1 | 0.0158 | 1.47 | 312 | 80 | 3 |
| | 2 | 0.0270 | 1.95 | 212 | 93 | 3 |
| Comparative Example | 2 | 0.0630 | 2.87 | 95 | 23 | 3 |
| Example | 3 | 0.0551 | 2.65 | 117 | 52 | 3 |
| | 4 | 0.0452 | 2.50 | 158 | 106 | 3 |
| | 5 | 0.0617 | 2.8 | 100 | 87 | 3 |
| | 6 | 0.0487 | 2.2 | 143 | 167 | 3 |
| Comparative Example | 3 | 0.0272 | 1.4 | 210 | 293 | 1 |
| | 4 | 0.0563 | 2.3 | 113 | 113 | 2 |
| | 5 | 0.0349 | 1.6 | 189 | 253 | 1(*)$_5$ |
| Example | 7 | 0.0714 | 3.2 | 80 | 74 | 3 |
| | 8 | 0.103 | 3.6 | 60 | 71 | 3 |
| Comparative Example | 6 | 0.135 | 2.6 | 48 | 48 | 1(*)$_6$ |

Note:
(*)$_4$ . . . Birefringenece
(*)$_5$ . . . Yarn breakages after occurred
(*)$_6$ . . . Individual filament breakages occurred In view of Tables 1, 2 and 3, the results of the examples and comparative examples are as follows.

In the low speed melt-spun polyester filament yarn produced in Comparative Example 1, since the straining rate of the extruded filamentary stream during the thinning process thereof is low, the elongate-deformation of the filament elongation-enhancing agent particles followed the elongate-deformation of the polyester resin matrix and thus substantially did not serve as resisting particles to the elongate-deformation of the polyester resin matrix in the melt state. Therefore, the resultant elongation-enhancing effect on the resultant polyester filament yarn is small. Also, in this case, since the number of the particles exposed to the peripheral surfaces of the individual filaments is large, in the resultant yarn package cob-webbing of the filament yarn was found.

In Examples 1, 4, 7, 12 and 13 in accordance with the present invention, all of the taking up speed of 2500 to 8000 m/minute and the requirements (a), (b) and (c) are satisfied, the residual elongation and the winding performance of the resultant polyester filament yarns were satisfactory, too. Especially, in the taking up speed of 3500 to 5500 m/minute, the effect of the present invention is maximized.

In Comparative Example 6, since the straining rate of the extruded filamentary stream during thinning process, thereof is very high, it is assumed that the filament-forming property of the melt mixture is degraded due to the interfacial separation occurred between the polyester resin matrix and the filament elongation-enhancing agent particles.

In Comparative Examples 2, since the amount of the filament elongation-enhancing agent particles is too small, the filament elongation-enhancing effect was unsatisfactory.

In Comparative Example 3 in which the filament elongation-enhancing agent particles were used in too large an amount, the resultant increase in residual elongation of 293% was sufficient, but the number (N) of the particles exposed to the peripheral surfaces of the filaments is too large and the resultant yarn package was unsatisfactory.

In Examples 3 and 6 in accordance with the present invention, the filament elongation-enhancing agent particles were used in an amount of 0.5 to 4.0% by weight, and thus the particles were disposed in the polyester resin matrix in a satisfactory condition.

In Comparative Example 4 in which the PMMA-(B) having a thermal deformation temperature (T) of 98° C. which does not satisfy the requirement (a) of the present invention, was employed, the resultant particle size (D) in the transverse direction was less than 0.05 μm, the number (N) of the particles exposed to the peripheral surfaces of the filaments is more than 15 particles per 100 μm$^2$ and the resultant filament yarn exhibited an unsatisfactory winding performance.

In Comparative Example 5, the filament elongation-enhancing agent (PMMA-(C)), exhibiting a thermal deformation temperature (T) of 140° C. which was higher than 130° C. and thus did not satisfy the requirement (a) of the present invention, was used. In this case, since the difference in the thermal deformation temperature (T) between the polyester resin and the particles was too large, the particles of the filament elongation-enhancing agent exhibited too high a resisting effect to the thermal elongate-deformation of the polyester resin, and the thermal deformation of the particles could not follow that of the polyester resin.

Also, the resultant PMMA-(C) particles distributed in the filaments had too large a particle size (D), and thus the polyester resin mixture exhibited a poor filament-forming property, and the resultant polyester filament yarn had an unsatisfactory winding performance.

Comparative Examples 7 to 9

In each of Comparative Examples 7 to 9, a polyester filament yarn was produced and wound by the following procedures.

A polyester resin chips having an intrinsic viscosity of 0.62 determined in the same manner as in Example 1, produced by a direct polymerization method, and containing 0.08% by weight of a delustering agent consisting of titanium dioxide pigment, were dried at a temperature of 160° C. for 5 hours. The dried resin chips were fed into a melt extruder through a chip-feeding conduit and a metering feeder. Also, polyester resin master chips containing 20% by weight of PMMA having a thermal deformation temperature of 121° C., a melt index of 1.0 g/10 minutes determined at a temperature of 230° C. under a load of 8 kgf, and a weight average molecular weight of 150,000 were fed into the melt extruder through a side conduit and a metering feeder, to provide a mixture of the polyester resin chips and the PMMA-containing polyester resin master chips, which mixture contained 1.0% by weight of the PMMA. The mixture was melted at a temperature of 300° C. while being agitated and the melt mixture was filtered through a metal filament filter having the pore size shown in Table 4 and then extruded through a spinneret having 36 nozzles each having the diameter as shown in Table 4, and arranged immediate below the filter, at the same spinneret temperature as in Example 1, at the draft ratio (Vw/Vo) shown in Table 4. The extruded filamentary streams were cooled, and oiled in the same manner as in Example 1 and taken up at a speed of 5000 m/minute. The resultant filament yarn had a yarn count of 133.3 dtex (120 denier)/36 filaments.

The test results are shown in Table 4.

TABLE 4

| Item Example No. | | Melt-spinning: Diameter of nozzles (mm) | Melt-spinning: Draft | Melt-spinning: Pore size of filter (μm) | Filament elongation-enhancing agent particles in individual filament: $D(*)_1$ (μm) | $L/D(*)_2$ | Percentage distribution density (%): Inside area | Intermediate area | Outer area | The number (N) of particles$(*)_3$ (particles/100 μm$^2$) | Polyester filament yarn: $\Delta n(*)_4$ | Tensile strength (g/de) | Ultimate elongation (%) | Increase in residual elongation (I) (%) | Package form |
|---|---|---|---|---|---|---|---|---|---|---|---|---|---|---|---|
| Comparative Example | 7 | 0.15 | 57 | 40 | 0.036 | 20 | 106 | 98 | 96 | 15 | 0.0655 | 2.8 | 94 | 45 | 3 |
| | 8 | 0.4 | 405 | 50 | 0.151 | 9 | 94 | 115 | 91 | 8 | 0.0495 | 2.5 | 136 | 109 | 2 |
| | 9 | 0.8 | 1620 | 25 | 0.189 | 6 | 91 | 109 | 100 | 7 | 0.0422 | 2.2 | 167 | 156 | 1 |

The results of the Comparative Examples 7 to 9 are as follows.

In Comparative Example 7 in which the diameter of the melt-spinning nozzles was 0.15 mm, the melt-spinning draft was 57 which was below 150, the requirement (b) of the present invention was not satisfied, and the increase (I) in the residual elongation was less than 50%. It is assumed that the filament elongation-enhancing agent melt was finely cut by a high shearing force generated in the very narrow melt-spinning nozzles, and the very fine particles of the filament elongation-enhancing agent exhibited a reduced elongation-enhancing effect.

In Comparative Example 7 wherein a filter having a pore size of 50 μm which was more than 40 μm was used, and the particle size (D) in the transverse direction was 0.151 μm which was more than 0.15, the resultant yarn package had cob-webbings.

In Comparative Example 8 wherein the melt-spinning nozzles had a large diameter of 0.8 mm and the melt-spinning draft was 1620 which was more than 1500, coarse particles of the filament elongation-enhancing agent were exposed to the peripheral surfaces of the individual filaments, and thus the resultant filament yarn had a significantly reduced coefficient of F/F friction. In this case, the burst phenomenon often occurred within mere several minutes from the start of winding.

Example 9 and Comparative Examples 10 and 11

In Example 9, a melt-spun polyester filament yarn was produced by the same procedures as in Example 6, and subjected to a false-twisting procedure at a heater length of 1.6 m, at a heater temperature of 180° C., at a draw ratio controlled to adjust the ultimate elongation of the resultant textured filament yarn to 25% at a false twisting disk-driving speed controlled to adjust a ratio ($T_1g/T_2g$) of a tension ($T_1g$) of the filament yarn located upstream to the false twisting disk to the tension ($T_2g$) of the filament yarn located downstream from the false twisting disk to 0.93.

In Comparative Example 10, the same melt-spun polyester filament yarn as in Comparative Example 8 was subjected to the same false twisting procedure as in Example 9.

In Comparative Example 11, a melt-spun yarn was produced by the same procedures as in Comparative Example 8, except that the content of the oiling agent containing, as a F/F friction-enhancing material, ethyleneoxide (10 moles)-addition-reacted nonylphenylether, in the aqueous oiling agent emulsion was changed from 10% by weight (Fa) to 25% by weight (Fb). The oiling agent emulsion was applied to the melt-spun filament yarn by a metering oiling nozzle during the melt-spinning procedure.

The melt-spun polyester filament yarn was subjected to the same false twisting procedure as in Example 9.

The test results are shown in Table 5.

TABLE 5

| Item | | Melt-spun filament yarn | | | | | | Draw-textured yarn | | |
|---|---|---|---|---|---|---|---|---|---|---|
| | | Oiling | | Tensile | Ultimate elonga- | F/F friction | | Tensile | Ultimate elonga- | The number |
| Example No. | Melt-spun filament | Composi-tion | OPU (%) | strength (g/de) | tion (%) | coeffi-cient | Package form | strength (g/de) | tion (%) | of fluffs per m |
| Comparative Example 10 | Comparative Example 8 | Fa | 0.27 | 2.5 | 136 | 0.25 | 2 | 4.9 | 25 | None |
| Example 9 | Example 6 | Fa | 0.29 | 2.2 | 143 | 0.28 | 3 | 4.7 | 26 | None |
| Comparative Example 11 | Comparative Example 8 | Fb | 0.26 | 2.6 | 134 | 0.30 | 3 | 4.5 | 25 | 5/m |

As Table 5 shows, in Comparative Example 10, since the melt-spun filament yarn exhibited a low coefficient of F/F friction, the resultant yarn package had cob-webbings. However, the melt-spun filament yarn could be smoothly textured by the false-twisting method, and had satisfactory physical properties and a high resistance to fluff-formation.

In Example 9, the melt-spinning and texturing procedures were smoothly carried out without any difficulty. The resultant textured filament yarn exhibited satisfactory properties.

In Comparative Example 11, the composition of the oiling emulsion was changed so as to increase the F/F friction. The resultant yarn package had a good form. However, the increased friction of the filament yarn caused the friction of the filament yarn with a texturing disk and yarn guides to increase, and thus the resultant textured yarn had a poor resistance to fluff-formation and was unsatisfactory.

What is claimed is:

1. A polyester filament yarn having an improved winding performance, produced by melt-spinning a mixture of a polyester resin with particles of a filament elongation-enhancing agent in an amount of 0.5 to 4.0% based on the weight of the polyester resin, and by taking up the melt-spun polyester filament yarn at a speed of 2500 to 8000 m/minute, to form a polyester filament yarn comprising a plurality of filaments each comprising a matrix consisting of the polyester resin and the filament elongation-enhancing agent particles dispersed in the polyester resin matrix, said polyester filament yarn exhibiting an increase (I) in residual elongation of 50% or more, determined in accordance with the equation:

$$I(\%)=(EI_b/EL_o-1)\times 100$$

wherein I represents the increase in residual elongation in % of the polyester filament yarn, $EI_b$ represents a residual elongation in % of the polyester filament yarn, and $EL_o$ represents a residual elongation in % of a comparative polyester filament yarn produced by the same procedures as those for the polyester filament yarn except that no filament elongation-enhancing agent is contained in the comparative polyester filament yarn and characterized in that said filament elongation-enhancing agent particles contained in the polyester filaments satisfy the requirements (a), (b) and (c):

(a) the filament elongation-enhancing agent particles have a thermal deformation temperature (T) in the range of from 105 to 130° C.;

(b) provided that the polyester filaments have a non-hollow circular cross-section, the distribution density of the filament elongation-enhancing agent particles in the circular cross-section of the polyester filament is maximized in an annular area between two concentric circles around the center of the circular cross-section, the radiuses of which two concentric circles correspond to ⅓ and ⅔ of the radius of the circular cross-section of the polyester filaments, respectively; and (c) the number (N) of the filament elongation-enhancing agent particles appearing on the peripheral surfaces of the polyester filament is 15 particles/100 $\mu m^2$ of less.

2. The polyester filament yarn as claimed in claim 1, wherein the thermal deformation temperature (T) of the filament elongation-enhancing agent particles is in the range of from 110 to 130° C.

3. The polyester filament yarn as claimed in claim 1, wherein the amount of the filament elongation-enhancing agent particles distributed in the annular area is 50% by weight on less, based on the total amount of the particles appearing in the circular cross-section.

4. The polyester filament yarn as claimed in claim 1, wherein the number (N) of the filament elongation-enhancing agent particles appearing on the peripheral surface of the polyester filament is 10 particles/100 $\mu m^2$ or less.

5. The polyester filament yarn as claimed in claim 1, wherein the filament elongation-enhancing agent particles distributed in the polyester filament has an average particle size (D) of 0.05 to 0.15 $\mu$m, determined in the transverse direction of the polyester filaments.

6. The polyester filament yarn as claimed in claim 5, wherein the filament elongation-enhancing agent particles distributed in the polyester filaments are elongated in the longitudinal direction of the polyester filament and has a ratio L/D of 20 or less, wherein L represents an average length of the particles determined in the longitudinal direction of the polyester filament and D represents the average size of the particles determined in the transverse direction of the polyester filaments.

7. The polyester filament yarn as claimed in claim 1, exhibiting a birefringence ($\Delta n$) in the range of from 0.015 to 0.105.

8. The polyester filament yarn as claimed in claim 1, wherein the filament elongation-enhancing agent particles comprise an addition-polymerization product of at least one ethylenically unsaturated organic monomer, said addition polymerization product of the unsaturated organic monomer being substantially imcompatible with the polyester resin and having a weight average molecular weight of 2000 or more.

9. The polyester filament yarn as claimed in claim 8, wherein the addition-polymerization product of the unsaturated organic monomer comprises an acrylate polymer comprising, as a principal component, an addition-polymerized methyl methacrylate and having a weight average molecular weight of 8,000 to 200,000 and a melt index of 0.5 to 8.0 g/10 minutes, determined at a temperature of 230° C. under a load of 3.8 kg.

10. The polyester filament yarn as claimed in claim 8, wherein the addition-polymerization product of the unsaturated organic monomer comprises a styrene polymer comprising, as a principal component, an isotactic styrene polymer and having a weight average molecular weight of 8,000 to 200,000 and a melt index of 0.5 to 8.0 g/10 minutes, determined at a temperature of 230° C. under a load of 3.8 kg.

11. The polyester filament yarn as claimed in claim 8, wherein the addition-polymerization product of the unsaturated organic monomer comprises a styrene polymer comprising, as a principal component, a syndiotactic (crystalline) styrene polymer and having a weight average molecular weight of 8,000 to 200,000 and a melt index of 6 to 2.5 g/10 minutes, determined at a temperature of 300° C. under a load of 2.16 kg.

12. The polyester filament yarn as claimed in claim 8, wherein the addition-polymerization product of the unsaturated organic monomer comprises a methylpentene polymer comprising, as a principal component, an addition polymerized 4-methylpentene-1 and having a weight average molecular weight of 8,000 to 200,000 and a melt index of 5.0 to 40.0 g/10 minute determined at a temperature of 260° C. under a load of 5.0 kg.

13. In a process for producing a polyester filament yarn, comprising:

extruding a melt of a mixture of a polyester resin with particles of a filament elongation-enhancing agent in an amount of 0.5 to 4.0% by weight based on the weight of the polyester resin through a spinneret, and taking up the melt-extruded polyester filament yarn at a speed of 2500 to 8000 m/minute along a spinning line, said process being characterized in that, in the melt-extruding step, the melt passes through a filter having a pore size of 40 $\mu$m or less arranged immediate upstream to the spinneret, and in the spinning line, a draft of the melt-extruded polyester filament yarn is controlled to a range of from 150 to 1,500, thus imparting said yarn an improved winding performance.

14. The process for producing the polyester filament yarn as claimed in claim 13, wherein in the taking-up step, the melt-extruded polyester filament yarns is cooled by blowing cooling air thereto downstream from the spinneret at a blowing speed controlled to a range of from 0.15 to 0.6 m/sec.

15. The process for producing the polyester filament yarn as claimed in claim 13, wherein in the melt-extruding step, the polyester resin, containing the filament elongation-enhancing agent particles dispersed therein in an amount of 0.5 to 4.0% by weight based on the weight of the polyester resin, and a polyester resin containing substantially no filament elongation-enhancing agent particles are melt-extruded by a co-spinning method and, in the taking-up step, the resultant mixed filament yarn is taken up at a speed of 2500 to 8000 m/minute.

* * * * *